United States Patent [19]

Mansell et al.

[11] Patent Number: 4,721,880

[45] Date of Patent: Jan. 26, 1988

[54] COLOR CATHODE RAY TUBE INCLUDING A CHANNEL PLATE ELECTRON MULTIPLIER

[75] Inventors: John R. Mansell, Eastgrinstead; Derek Washington, Wallington, both of Great Britain; Willem M. van Alphen, Eindhoven, Netherlands

[73] Assignee: U.S. Philips Corporation, New York, N.Y.

[21] Appl. No.: 822,176

[22] Filed: Jan. 24, 1986

[30] Foreign Application Priority Data

Feb. 13, 1985 [GB] United Kingdom ..... 8503677

[51] Int. Cl.[4] ..... H01J 29/70; H01J 29/72

[52] U.S. Cl. ..... 313/422; 315/366; 313/103 CM; 313/105 CM

[58] Field of Search ..... 313/422, 103 CM, 105 CM; 315/366

[56] References Cited

U.S. PATENT DOCUMENTS 4,560,898 12/1985 Knapp et al. ..... 313/103 CM

*Primary Examiner*—Theodore M. Blum

*Attorney, Agent, or Firm*—Robert J. Kraus

[57] ABSTRACT

A channel plate electron multiplier is mounted parallel to, but spaced from, the screen. The electron multiplier comprises a stack of juxtaposed substantially planar apertured dynodes with the apertures therein aligned to form channels. An apertured extractor electrode is mounted on the output side of the electron multiplier. Preferably two or more foraminous deflector electrodes are mounted on the extractor electrode. The apertures in the foraminous deflector electrodes have the same pitch as the channels of the electron multiplier but are offset laterally relative to each other and to the axes of the channels by amounts which allow the emergent electron beam from each channel to pass through to the screen without impinging upon the deflector electrodes. By applying a potential difference between the deflector electrodes an electron beam emerging from its respective channel is deflected laterally onto a respective one of its associated group of phosphor stripes. The apertures in the deflector electrodes may be circular, elliptical or polygonal for example square, rectangular or hexagonal.

19 Claims, 18 Drawing Figures

Fig. 13.
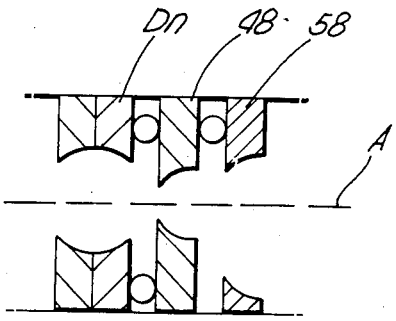
Fig. 14.
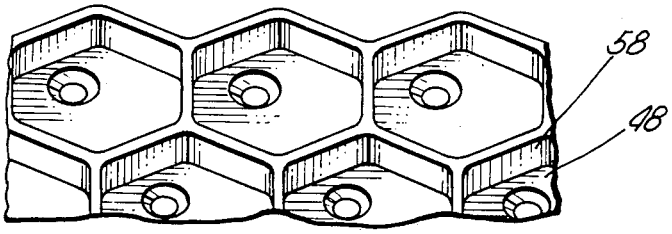
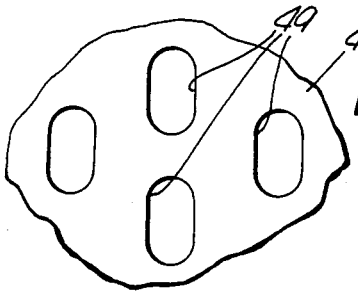
Fig. 15.
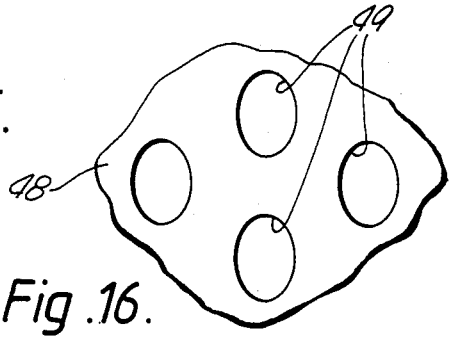
Fig. 16.
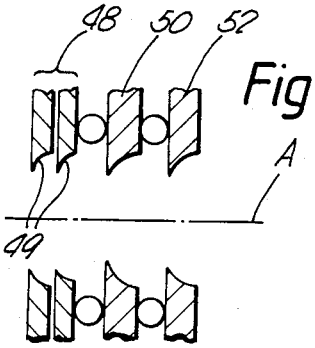
Fig. 17.
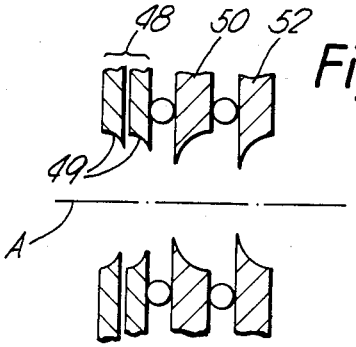
Fig. 18

COLOR CATHODE RAY TUBE INCLUDING A CHANNEL PLATE ELECTRON MULTIPLIER

BACKGROUND OF THE INVENTION

The present invention relates to a cathode ray tube including a channel plate electron multiplier and more particularly to the production of images in two or more colors in such tubes.

British Patent Specification Nos. 1446774, 1452554 and 2143077A disclose a method of producing color images in a cathode ray tube including a channel plate electron multiplier in which the electron beam emerging from a channel is subjected to an electrostatic field whereby the beam is formed into a dot or a circle of variable diameter. The phosphor screen comprises a dot of one color surrounded by a ring of another color which is surrounded by a third color. In order to produce the necessary electrostatic fields to cause the electron beam to impinge upon the relevant phosphor, one or more apertured electrodes are mounted on the extractor electrode of the channel plate electron multiplier. The apertures in the or each electrode are circular having the same pitch as the apertures in the electron multiplier. By adjusting the focusing voltages applied to the extractor electrode and the or each electrode carried thereby, the cross sectional shape of the beam can be changed from cylindrical to annular. The color selection electrode or electrodes consist of etched components which are easily manufactured, for example from mild steel which may be used in forming the half dynodes of the electron multiplier. Although this method of color selection is viable, it has the disadvantages that high and complex switching voltages are required and also very accurate alignment is needed between the electron multiplier and the fluorescent screen.

British Patent Specification Nos. 2124017A and 1458909 disclose a method of color selection in which elongate deflection electrodes are disposed between the columns of channels in the channel plate electron multiplier. In particular when pairs of interdigitated electrodes are disposed between the columns of channels on the output side of the electron multiplier (Specification No. 2124017A) the quality of the colored image produced is of a very high standard. In operation the electrons emerging from the channels are subjected to an asymmetric lens field which elongates the electron beams in the column direction whilst simultaneously deflecting them to a series of color stripes on the screen. This method has acceptable switching voltages and much less stringent requirements for alignment between the multiplier and the screen as compared to the dots and rings method. However a series of pairs of deflection electrodes positioned between each column of channels is required and this arrangement is difficult to realize in practice.

SUMMARY OF THE INVENTION

An object of the present invention is to produce a practical method of providing an image in at least two colors on the screen of a cathode ray tube including a channel plate electron multiplier.

According to the present invention there is provided a color cathode ray tube characterised by an envelope having therein a screen comprising at least two sets of cathodoluminescent stripes of different colors, a channel plate electron multiplier formed by a stack of juxtaposed substantially planar apertured dynodes arranged so that the apertures therein form channels, at least one apertured extractor electrode mounted on the output side of the electron multiplier and at least one foraminous deflector electrode carried by the extractor electrode, apertures in the foraminous deflector electrode having the same pitch as the channels of the electron multiplier and being offset relative to the axes of the channels by an amount which enables the emerging electron beams to pass therethrough, whereby in operation a potential difference is provided between the extractor electrode and the deflector electrode to deflect an electron beam emerging from a channel laterally of the cathodoluminescent stripes.

The present invention also provides a color cathode ray tube characterised by an envelope having therein a screen comprising at least two sets of cathodoluminescent stripes of different colors, a channel plate electron multiplier formed by a stack of juxtaposed substantially planar apertured dynodes arranged so that the apertures therein form channels, at least one apertured extractor electrode mounted on the output side of the electron multiplier and at least two juxtaposed foraminous deflector electrodes carried by the extractor electrode, apertures in each of the foraminous deflector electrodes having the same pitch as the channels of the electron multiplier, the apertures in the extractor electrode and in each of the deflector electrodes being offset laterally relative to each other about the axes of the channels by amounts which allow substantially free passage of the emergent electron beams therethrough, whereby in operation a potential difference is provided between adjacent deflector electrodes to deflect an electron beam emerging from a channel laterally relative to the direction of elongation of the stripes.

An advantage of asymmetrically mounting the deflector electrode or electrodes is that in operation one or more asymmetrical electron lens fields are formed between the adjacent extractor and deflector electrode(s) which field or fields elongate the cross section of the electron beams in the direction of the stripes and a narrowing at right angles to the stripes which leads to improved color purity because the tails do not impinge on to the next stripe.

The lateral offset of the deflector electrodes relative to the axes of the channels may be equal and opposite, may be unequal or in the case of more than two deflector electrodes adjacent electrodes may be offset on the same side of the channel axes by the same or different amounts or may be arranged as interdigitated pairs with each pair having substantially the same offset.

The or each foraminous deflector electrode may be an etched component and because the positions of the apertures in the deflector electrodes correspond to those of the channels in the electron multiplier they are automatically offset by the same amount which may not be the case when using elongate deflector electrodes. Any misalignment in the lateral direction can be corrected electrically. Further the etched components are easier and cheaper to make especially when fabricated from etched mild steel.

The apertures in the or each deflector electrode may be of any convenient shape such as circular, elliptical or polygonal such as square, rectangular or hexagonal. An advantage of having polygonal shaped apertures is that the open area of the electrode can be greater and this would reduce the risk of beam interception which might lead to a loss of light output from the screen and also the undesired production of secondary electrons which may cause a halo effect around the spot on the screen.

In selecting the number of deflector electrodes regard has to be made to the actual voltage differences applied to the deflector electrodes to obtain the desired deflection and as a guideline the voltage differences required become lower the greater the number of deflector electrodes. As an example in the case of one pair of deflector electrodes the deflection voltage swing is of the order of ±75 volts whereas in the case of two pairs of interdigitated electrodes the deflection voltage swing is reduced to ±50 volts. It is desirable to keep the voltage differences as low as possible so that the power requirements of the drive circuits can be minimized.

In selecting the extractor electrode voltage and the mean deflection voltage regard has to be made to the spot shape and preferably the spot should have the smallest possible tails at the edges thereof otherwise there is a risk that larger tails might cause undesirable light output from adjoining phosphor stripes of different colors.

BRIEF DESCRIPTION OF THE DRAWING

The present invention will now be described, by way of example, with reference to the accompanying drawing figures, wherein:

FIG. 13 is a diagrammatic view of a color deflection arrangement having a single apertured, eccentrically mounted deflector arrangement, FIG. 14 is a diagram of a single color deflector electrode in which the apertures are hexagonal, and FIGS. 15 to 18 illustrate diagrammatically different embodiments of extractor electrodes to that shown in FIG. 2.

In the drawings corresponding reference numerals have been used to indicate the same parts in each of the embodiments.

DESCRIPTION OF THE PREFERRED EMBODIMENT

Figure 1:
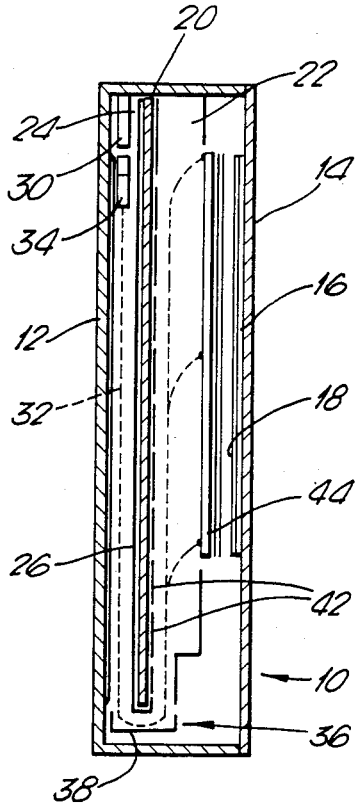
FIG. 1 is a diagrammatic elevation through a flat color cathode ray tube made in accordance with the present invention.
Figure 2:
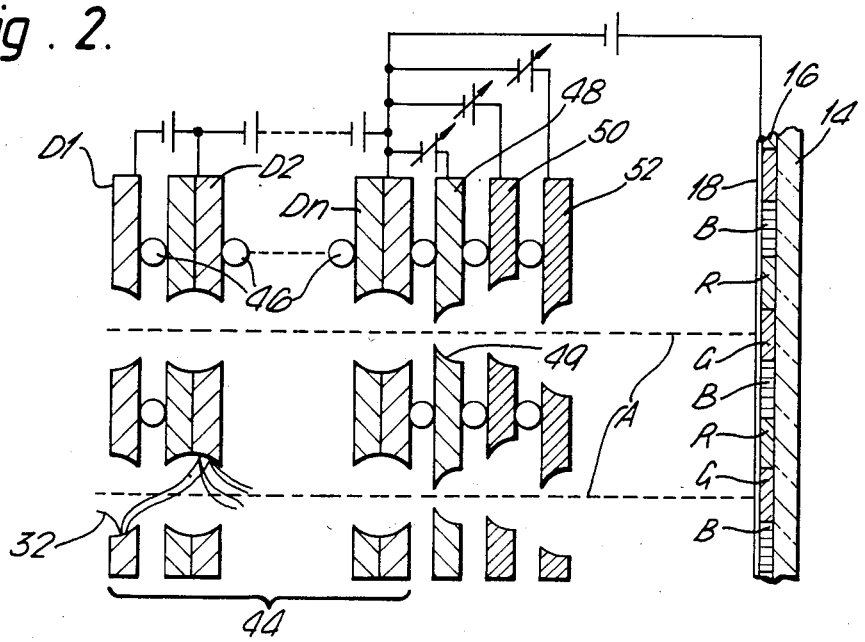
FIG. 2 is a diagrammatic horizontal cross section through an electron multiplier, an extractor electrode, deflector electrodes and a screen suitable for use in a cathode ray tube made in accordance with the present invention.

Referring to FIGS. 1 and 2, the flat display tube 10 comprises a metal envelope 12 to which an optically transparent, planar faceplate 14 is connected by a suitable vacuum tight seal. On the inside of the faceplate 14 is a phosphor screen 16 comprising repeating groups of red (R), green (G) and blue (B) phosphor stripes with an electrode 18 thereon.

For convenience of description, the interior of the envelope 12 is divided in a plane parallel to the faceplate 14 by an internal partition or divider 20 to form a front portion 22 and a rear portion 24. The divider 20, which comprises an insulator such as glass extends for substantially a major part of the height of the envelope 12. A planar electrode 26 is provided on a rear side of the divider 20. The electrode 26 extends over the exposed edge of the divider 20 and continues for a short distance along its front side.

Means 30 for producing a downwardly directed electron beam 32 is provided in the rear portion 24 adjacent an upper edge of the envelope 12. The means 30 may be an electron gun of the hot or cold cathode type. A downwardly directed electrostatic line deflector 34 is spaced by a short distance from the final anode of the electron beam producing means 30 and is arranged substantially coaxially thereof. If desired the line deflector 34 may be electromagnetic.

At the lower end of the interior of the envelope 12 there is provided a reversing lens 36 comprising a trough-like electrode 38 which is spaced below and disposed symmetrically with respect to the lower edge of the divider 20. By maintaining a potential difference between the electrodes 26 and 38 the electron beam 32 is reversed in direction whilst continuing along the same angular path from the line deflector 34.

On the front side of the divider 20 there is provided a plurality of laterally elongate, vertically spaced electrodes 42 which are selectively energised to provide frame deflection of the electron beam 32 onto the input surface of a laminated dynode electron multiplier 44.

The typical construction of the channel plate electron multiplier 44 is disclosed in a number of prior British Patent Specifications of which two examples are Specification Nos. 1434053 and 2023332A, details of which are incorporated herein by way of reference. Accordingly a detailed description of the construction and operation of the electron multiplier 44 will not be given but for the sake of completeness the electron multiplier 44 comprises a stack of apertured dynodes D1, D2 . . . Dn of which the first two and last one are shown in FIG. 2. The apertures in all but the first dynode are of re-entrant shape, for example barrel shaped, and the apertures in successive dynodes are aligned with each other to form channels. The dynodes may be made of a material having a high secondary electron emission coefficient but in the case of those having a large area they will be made of mild steel which can be accurately etched more easily than some known materials having a high secondary electron emission coefficient. The first dynode D1 is thinner than the remaining dynodes and the apertures in the first dynode converge in a direction towards the next following dynode D2. As it is difficult to etch re-entrant shaped apertures in a single sheet of material then conveniently the second and subsequent dynodes are made by placing two half dynodes having converging apertures back to back so that the surfaces into which the larger cross sectional aperture opens abut. The thinner, first dynode D1 may conveniently comprise a half dynode. Successive dynodes are separated from each other by a resistive or insulating spacing means which in the illustrated embodiments comprise glass balls 44 known as ballotini. In the case of the dynodes being made of mild steel then a secondary emitting material, for example magnesium oxide, can be provided in the apertures of the dynodes. In operation a potential difference of between 200 and 500 volts d.c. typically exists between successive dynodes and a potential difference of the order of 8 kV exists between the last dynode Dn and the screen. In order to extract the current multiplied electron beam from the last dynode Dn of the electron multiplier, an apertured extractor electrode 48 is provided. This extractor electrode 48 which generally comprises the same sheet material as is used to make a half dynode is mounted on, but spaced from, the final dynode. In the embodiment shown in FIG. 2 the apertures in the extractor electrode 48 are smaller than those in the half dynodes but their pitch is the same. By making the apertures smaller then the extracted beams from the channels undergo some degree of beam shaping because secondary electrons which are too far off their respective channel axis A strike the extractor electrode 48 and do not take any further part in the production of an optical image at the screen 16.

In the illustrated embodiment two foraminous deflector electrodes 50, 52 are mounted on the extractor electrode 48. The apertures in the foraminous electrodes 50, 52 have the same pitch as those of the electron multiplier 44 and the extractor electrode 48 but these deflector electrodes are offset laterally with respect to each other and with respect to the axis A of each channel. The degree of offset of the respective electrodes is such that the through-aperture is of such a size as to permit the electron beam emerging from a channel to pass therethrough without impinging on the electrodes 50, 52 thereby avoiding the risk of the undesired production of secondary electrons. The shape of the apertures in the electrodes 50, 52 may be other than circular, such as polygonal, for example square and hexagonal, or generally elongate in the direction of elongation of the phosphor stripes, for example, elliptical, rectangular or parallel sided with curvilinear ends. In FIG. 2 the apertures in the electrodes 50, 52 are circular or elliptical with the major axis being vertical. Examples of polygonal shapes will also be described and illustrated.

The deflector electrodes 50, 52 may be made of etched mild steel. In one example the thickness of these electrodes is between 0.15 and 0.20 mm and the spacing between the extractor electrode 48 and the electrode 50 and between the deflector electrodes 50, 52 is between 0.05 mm and 0.2 mm. Ballotini may again comprise a suitable spacing means. In choosing the size of the holes in the deflector electrodes 50, 52 regard has to be made to the fact that if the hole size is too small, then electrons will strike the electrodes and produce secondary electrons but on the other hand if they are too big, then the sensitivity of deflection relative to change of deflector voltages will be reduced. As an example for an arrangement wherein the small hole size of extractor electrode 48 is 0.13 mm, and the exit aperture of the multiplier 44 is 0.3 mm small hole size, then the minimum deflector electrode hole size is 0.45 mm.

In one mode of operation of the illustrated display tube the following typical voltages are applied reference being made to 0 V, the cathode potential of the electron gun 30. The electrode 26 and the metal envelope 12 are at 400 V to define a field free space in which line deflection takes place with potential changes of about ±30 V applied to the line deflectors 34. As the angular deflection of the electron beam continues after a reflection of 180° in the reversing lens 36 then the maximum angles need only be of the order of ±26° but the actual value depends on the screen size. The trough-like electrode 38 of the reversing lens is at 0 V compared to the 400 V of the extension of the electrode 26 around the bottom edge of the divider 20. The input surface of the electron multiplier 44 is at 400 V whilst at the beginning of each frame scan the electrodes 42 are at 400 V but are reduced to 0 V in a predetermined sequence in which initially the electron beam 32 in the front portion 22 is deflected into the topmost apertures of the electron multiplier 44. Subsequently the electrodes 42 are in turn reduced to 0 V so that the electron beam is deflected towards the electron multiplier 44 in the vicinity of the next electrode 42 in the group to be at 0 V. The voltage across each dynode of the electron multiplier 44 is typically +300 V per stage although the precise voltage depends on the secondary emitter used and could be as high as 500 V. Thus for a 10 dynode multiplier the total potential difference is 3.0 kV which, allowing for the 400 V on the input side of the multiplier, means that the potential at the output side is equal to 3.4 kV. The electrode 18 is typically at a potential of 11 kV to form an accelerating field between the output side of the electron multiplier 44 and the screen 16.

Color selection by deflecting the electron beam emerging from each channel may be carried out by applying the following exemplary voltages to the electrodes 48, 50, 52, these voltages being measured with respect to the last dynode Dn of the electron multiplier 44 which will be taken as zero volts. The extractor electrode 48 is at +40 volts relative to the dynode Dn and causes the electron beam emerging from each channel to be drawn out from the multiplier 16 and be focused. In the case of the extracted beam being passed undeflected to the central phosphor stripe G of the group of three, each of the electrodes 50, 52 is at 350 volts. For deflection in one direction the first deflector electrode 50 is at 300 volts whilst the second deflector electrode 52 is at 400 volts and conversely to get deflection in the opposite direction then the first electrode is at 400 volts and the second electrode is at 300 volts. An effect of these voltages and the offset positioning of the deflector electrodes is that an asymmetrical electron lens is produced which causes the electron beam emerging from the channel to be elongated vertically which makes the beam more suitable for use with a striped screen.

Reference will now be made to FIGS. 3 to 7 which show diagrammatically an embodiment in which there are two deflector electrodes 50, 52, having rectangular apertures 54, 56, respectively, offset relative to each other and to the axis A of their associated channel. In the illustrated embodiment each of the deflector electrodes 50, 52 is of lattice form with the apertures in adjacent columns being displaced vertically in order to align with the corresponding channels of the electron multiplier.

Figure 3:
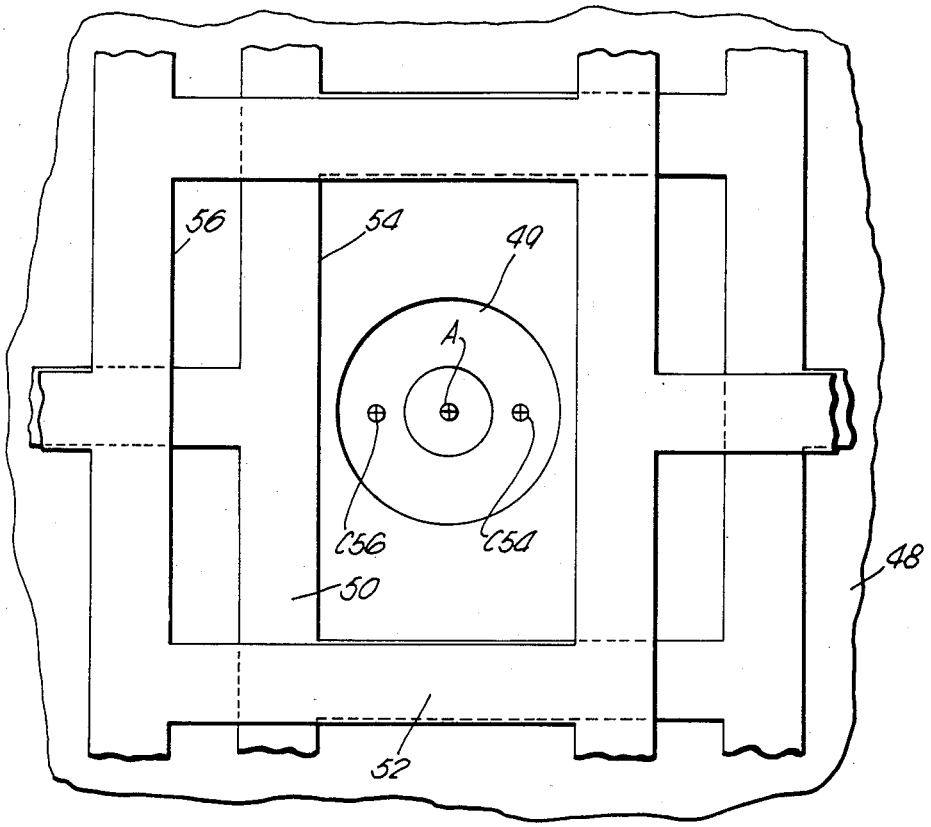
FIGS. 3 to 7 are diagrams, including computer trajectory plots, concerning a color deflection arrangement having rectilinear apertures in a pair of deflector electrodes.

In FIG. 3 the centres C54 and C56 of the apertures 54, 56 are laterally offset equally and oppositely with respect to the channel axis A. As is evident from this figure the width of the through-passage formed by the partially overlapping apertures 54, 56 is slightly greater than the large hole diameter of the divergent circular cross section aperture 49 in the extractor electrode 48.

Figure 4:
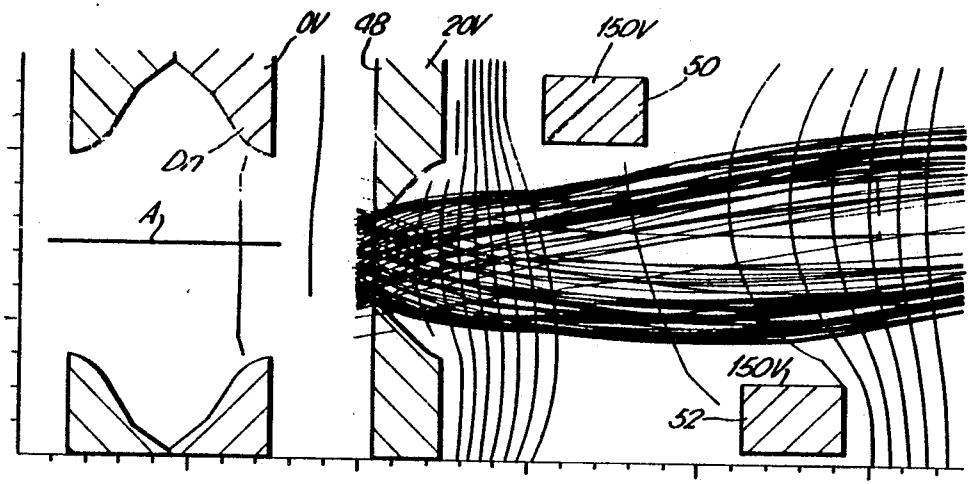
Figure 5:
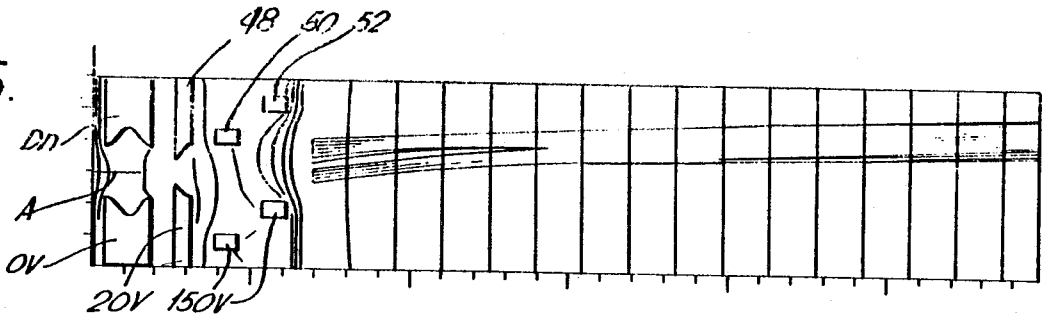

FIGS. 4 and 5 are computer trajectory plots of inside the deflection region and in the multiplier-to-screen space, respectively, for the case where no deflection of the extracted electron beam occurs. In these drawings the electron beam paths are generally horizontal and the equi-potential lines forming the lens field are generally vertical. Taking the last dynode Dn as being at a reference voltage of zero volts, then the extractor electrode 48 is at +20 volts and each of the deflector electrodes 50, 52 is at a mean voltage of +150 volts. FIG. 4 shows that the electric field is very astigmatic in the deflection region and that, as viewed in this figure, the electrons from the upper and lower halves of the final dynode Dn trace different shaped paths. Investigations have shown that the electrons do meet at the same point on the screen, but that this point, as shown in FIG. 5, is not necessarily on the axis A of the channel.

Figure 6:
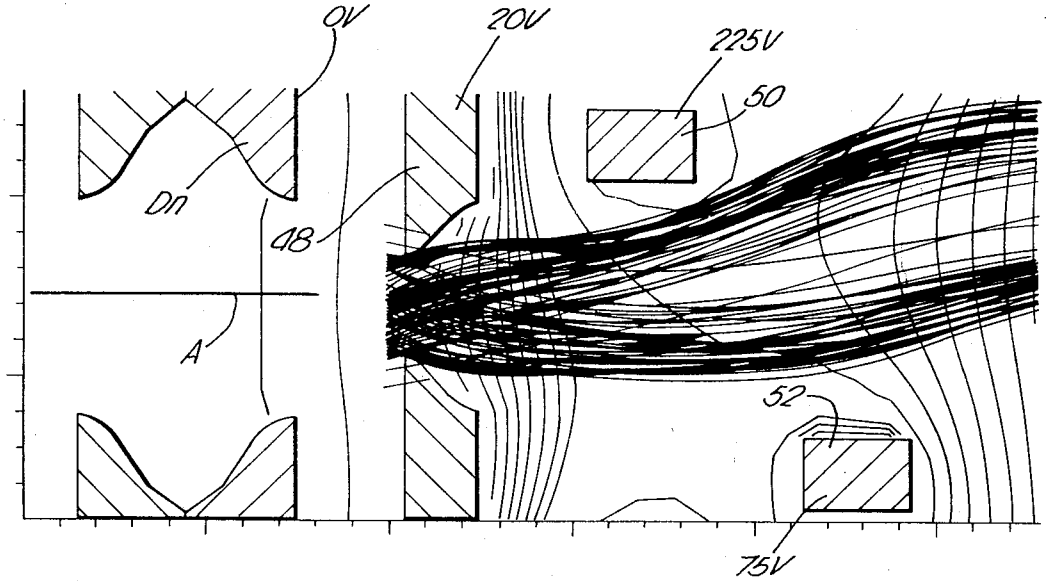
Figure 7:
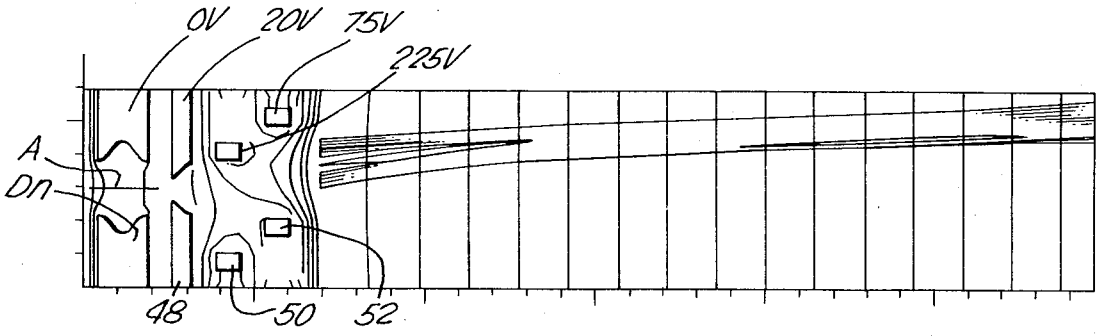

FIGS. 6 and 7 are computer trajectory plots at locations corresponding to those shown in FIGS. 4 and 5, respectively, which show the electron beam emerging from the channel in the last dynode Dn being deflected further from the axis A of the channel. The deflection of the electron beam is enabled by modifying the asymmetrical electron lens fields formed between the extractor electrode 48 and the deflector electrodes 50, 52. In the illustrated case this modification was achieved by maintaining the extractor electrode voltage at +20 volts, increasing the first deflection electrode 50 voltage to +225 volts and reducing the second deflection electrode 52 voltage to +75 volts, that is a swing of ±75 V with respect to the mean voltage.

Figure 8:
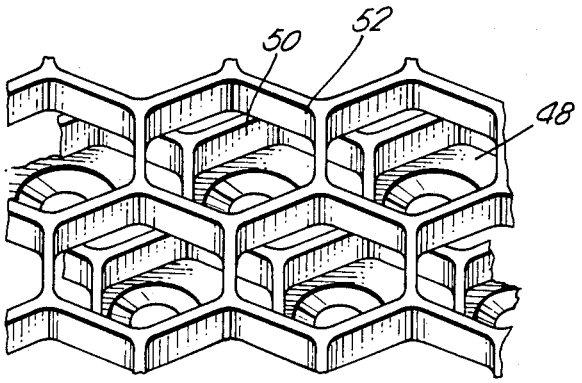
FIG. 8 is a diagram of a color deflection arrangement having two deflector electrodes with hexagonal apertures.

FIG. 8 is an illustration showing the use of deflector electrodes 50, 52 with hexagonal apertures. As in the cases of the other embodiments the centres of the apertures in electrodes 50, 52 are offset laterally one on each side of the channel axis. The pitch of the apertures in each of the electrodes 50, 52 corresponds to the pitch of the channels and the size of the apertures is made as large as possible to maximise the transparency but in so doing regard has to be made to several factors including mechanical rigidity and ensuring that the asymmetrical lens fields have the required strength.

In the embodiments described the deflector electrodes 50, 52 are offset equally and oppositely about the axis of each channel, however embodiments are contemplated in which the spacing is unequal.

Figure 9:
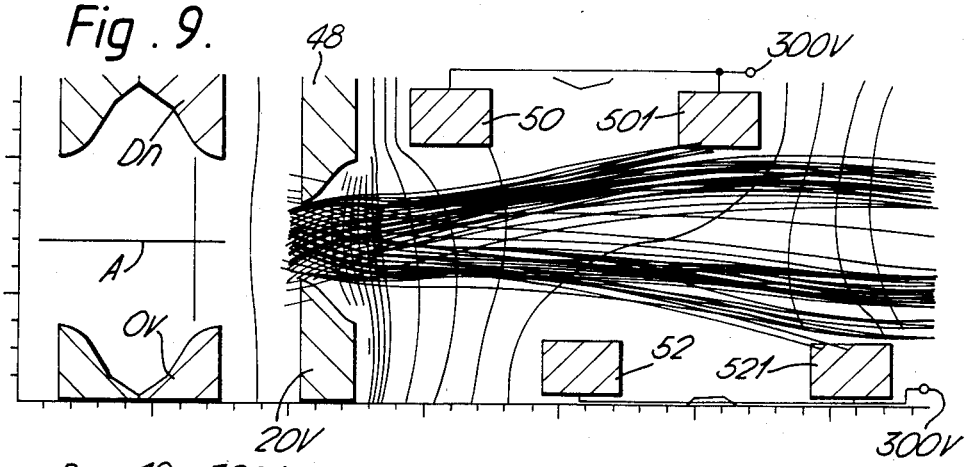
FIGS. 9 to 12 are computer trajectory plots relating to two pairs of interdigitated deflector electrodes each with rectilinear apertures.
Figure 10:
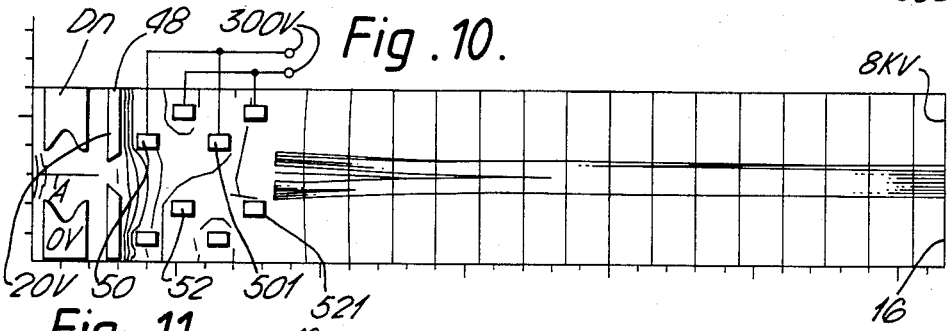
Figure 11:
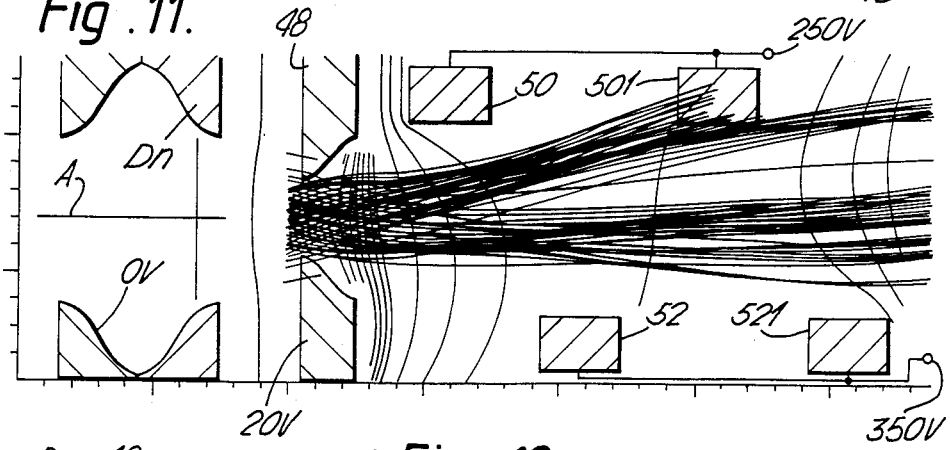
Figure 12:
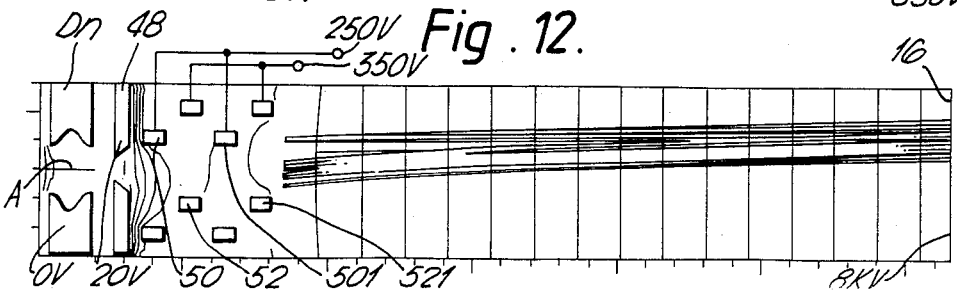

FIGS. 9 to 12 illustrate another embodiment of the invention in which there are provided four deflector electrodes 50, 52, 501, 521 connected as interdigitated pairs 50, 501 and 52, 521, respectively. FIGS. 9 and 10 show inside the deflection region and the multiplier-to-screen space, respectively, for the case where the electron beam is undeflected and FIGS. 11 and 12 show the case where the electron beam is deflected. The operation of the tube and the deflector arrangement is somewhat the same as described with reference to FIGS. 3 to 7 but the voltages are lower and, in order to provide the required deflection, swings of + and −50 volts are used. Within certain limits the deflection voltages become smaller with the greater number of deflection electrodes.

If desired the electrodes 50, 52, 501 and 502 need not be connected as interdigitated pairs in which case the voltage applied to each electrode can be adjusted as required.

Although even numbers of electrodes have been used in the multi-electrode arrangements described so far, a single offset deflector electrode can be used as well as odd numbers of deflector electrodes. With four or more deflector electrodes with alternate electrodes interconnected electrically to form sets, each set of electrodes may be offset equally and oppositely relative to the other set about the channel axes, may be offset unequally and oppositely relative to the other set about the channel axes, or may be arranged so that two adjacent deflector electrodes, one from each set, are offset to one side of the channel axes and at least one other deflector electrode from each set are offset to the opposite side of the channel axes.

FIG. 13 illustrates an embodiment of the invention in which there is only one deflector electrode 58 which is mounted offset with respect to the channel axis A. The asymmetrical lens field in this embodiment is produced between the extractor electrode 48 and the deflector electrode 58 to elongate the beam. However as it is not possible to reverse the lens field as is done in the multiple deflector electrode embodiments, the electron beam can only be deflected in one direction from a nominal position rather than to either side of the nominal position if there are two or more deflector electrodes. Typical operating conditions for such an arrangement are that taking the final dynode Dn as zero volts the extractor electrode 48 can be held between +20 and +40 volts and the mean deflection voltage applied to the deflector electrode 58 is +200 volts, to obtain a first deflection the deflector electrode 58 voltage is reduced to +20 volts, that is a swing of 180 volts less than the mean deflection voltage and to obtain a second deflection the deflector electrode 58 voltage is set to +380 volts, that is 180 volts above the mean deflection voltage. As the extraction efficiency is reduced by holding the deflector electrode 58 at +20 volts such an arrangement is not really suitable for use in producing a full color television type of display but may be used for a datagraphic display having two primary colors and several intermediate colors therebetween.

FIG. 14 illustrates a variant of the arrangement shown in FIG. 13 in which the apertures in the deflector electrode 58 are hexagonal.

Although by having circular or circularly symmetrical apertures 49 in the extractor electrode 48 of a smaller diameter than the minimum diameter of the channels one has a good beam shape because extraneous electrons are blocked, this does have the disadvantage that the extraction efficiency of the electrode 48 is reduced. This disadvantage can be partially offset by providing apertures which are elongated in the direction of the phosphor stripes. Two examples of alternative aperture shapes are shown in FIGS. 15 and 16. In the case of FIG. 15 the apertures 49 are substantially straight sided with curvilinear ends and in FIG. 16 the apertures 49 are generally elliptical. In operation the extractor electrode 48 is operated at a higher voltage, for example between +100 and +150 volts with respect to the last dynode Dn, than in the case of using small circular apertures in the extractor electrode 48. The voltage swings applied between the deflector electrodes 50, 52 and the screen voltage are substantially the same as described with reference to FIGS. 4 to 7.

The extractor electrode 48 may comprise a single sheet of material having the thickness of a half dynode but it may also comprise two sheets of material which are either contiguous or spaced apart. In the case of using two sheets the apertures 49 can diverge, as shown in FIG. 17, or converge, as shown in FIG. 18 in a direction towards the screen.

As a general rule the following factors have to be taken into account when considering the construction and operation of this type of electron beam deflection system, namely (1) the cross section of the apertures in the extractor electrode (2), the thickness of the deflector electrodes, (3) the degree of offset of the deflector electrodes, (4) the relative spacing between the deflector electrodes, (5) the spacing between the deflector electrodes and the cathodoluminescent screen, (6) the number of deflector electrodes and (7) the voltages applied thereto.

One approach to making an operating arrangement which endeavours to take into account the factors (1) to (7) above is to select electrodes of a nominal thickness and aperture size and mount them with a nominal spacing between them, for example the same spacing as that between the dynodes of the electron multiplier 44. The extractor electrode voltage and the mean voltage applied to the deflector electrodes are then adjusted in order to obtain the desired asymmetrical spot of an acceptable size. More particularly the extractor voltage is fixed and the mean deflection voltage is adjusted and the spot width is measured at half height. This is done for several extractor voltages and from the curves drawn up one can determine the conditions to obtain minimum spot width. In so doing fixes the voltage to be applied to the extractor electrode, this voltage should not be too small because it will mean that the efficiency of the extractor electrode will be reduced. The mean deflection voltage will also be determined by this operation and the actual deflection voltages required are determined experimentally. Simulation by computer trajectory plots can simplify the overall operation.

Measurement of the spot profile is important because it will determine the color points on the screen and the width of the black matrix between adjacent stripes. Ideally the spot profile should be one that has a sharp peak and small tails rather than a slowly rising peak and extended tails which would mean that a small proportion of the electrons on the periphery of the spot would impinge on the phosphor stripe either side of the intended stripe and lead to color distortion.

Although a flat cathode ray tube has been described with reference to the drawings. the color deflection arrangements can be applied to magnetically and electrostatically scanned display tubes including a channel plate electron multiplier and an electron gun arranged on the tube axis or laterally offset relative to the electron multiplier, the point being that the color selection takes place between the electron multiplier and the screen, this being independent of the origin of the electron beam and the scanning of the input side of the electron multiplier.

We claim:

1. A color cathode ray tube including an envelope having therein an electron gun, a screen comprising at least two sets of cathodoluminescent stripes of different colors, a channel plate electron multiplier formed by a stack of juxtaposed substantially planar apertured dynodes arranged so that the apertures therein form channels having respective axes, at least one apertured extractor electrode mounted on an output side of said electron multiplier and at least one foraminous deflector electrode carried by said extractor electrode, apertures in the foraminous deflector electrode having the same pitch as the channels of the electron multiplier and being offset relative to the axes of the channels by an amount which enables the emerging electron beams to pass therethrough, whereby in operation a potential difference is provided between the extractor electrode and the deflector electrode to deflect an electron beam emerging from a channel laterally of the cathodoluminescent stripes.

2. A color cathode ray tube including an envelope having therein an electron gun, a screen comprising at least two sets of cathodoluminescent stripes of different colors, a channel plate electron multiplier formed by a stack of juxtaposed substantially planar apertured dynodes arranged so that the apertures therein form channels having respective axes, at least one apertured extractor electrode mounted on an output side of said electron multiplier and at least two juxtaposed foraminous deflector electrodes carried by said extractor electrode, apertures in each of said foraminous deflector electrodes having the same pitch as the channels of said electron multiplier, the apertures in the extractor electrode and in each of the deflector electrodes being offset laterally relative to each other about the axes of the channels by amounts which allow substantially free passage of the emergent electron beams therethrough, whereby in operation a potential difference is provided between adjacent deflector electrodes to deflect an electron beam emerging from a channel laterally relative to the direction of elongation of the stripes.

3. A color cathode ray tube as claimed in claim 2, having two pairs of said deflector electrodes, the electrodes of one of said pairs being interleaved with the electrodes of the other of said pairs.

4. A color cathode ray tube as claimed in claim 1, 2 or 3, where the at least one deflector electrode is an etched component.

5. A color cathode ray tube as claimed in claim 4, wherein the or each deflector electrode comprises mild steel.

6. A color cathode ray tube as claimed in claim 4, where the apertures in the at least one deflector electrode are circular.

7. A color cathode ray tube as claimed in claim 4, where the apertures in the at least one deflector electrode are polygonal.

8. A color cathode ray tube as claimed in claim 4, where the apertures in the at least one deflector electrode are elongate in a direction parallel with the phosphor stripes.

9. A color cathode ray tube as claimed in claim 8, where the apertures in the at least one deflector electrode are elliptical.

10. A color cathode ray tube as claimed in claim 8, where the apertures in the at least one deflector electrode are rectangular.

11. A color cathode ray tube as claimed in claim 8, where the apertures in the at least one deflector electrode are straight sided with curvilinear ends.

12. A color cathode ray tube as claimed in claim 1 or 2, where there are at least two deflector electrodes, adjacent ones of said deflector electrodes having equal but opposite offsets with respect to the channel axes.

13. A color cathode ray tube as claimed in claim 1 or 2, where there are at least two deflector electrodes, adjacent ones of said deflector electrodes having unequal and opposite offsets with respect to the channel axes.

14. A color cathode ray tube as claimed in claim 1 or 2, where there are at least four deflector electrodes, with alternate deflector electrodes being interconnected electrically to form respective sets, the electrodes of each set being equidistantly offset on opposite sides of the channel axes.

15. A color cathode ray tube as claimed in claim 1 or 2, where there are at least four deflector electrodes, with alternate electrodes being interconnected electrically to form respective sets, an adjacently positioned deflector electrode from each set is offset to one side of the channel axes and at least one other deflector electrode of each set being offset to the opposite side of the channel axes.

16. A color cathode ray tube as claimed in claim 1 or 2, where the apertures in the at least one deflector electrode are larger than the apertures in the at least one extractor electrode.

17. A color cathode ray tube as claimed in claim 1 or 2, where the apertures in the at least one extractor electrode are circularly symmetrical with a minimum cross sectional dimension which is smaller than the minimum diameter of the channels.

18. A color cathode ray tube as claimed in claim 1 or 2, where the apertures in the at least one extractor electrode are of elongate form, with the longer dimension being substantially parallel to the phosphor stripes.

19. A color cathode ray tube as claimed in claim 1 or 2, where said envelope is flat and further comprising means for folding the electron beam from said electron gun through 180° in its trajectory to an input side of said electron multiplier.

* * * * *